United States Patent [19]

Williams

[11] 4,075,457

[45] Feb. 21, 1978

[54] PEDICURE TREATMENT UNIT

[75] Inventor: E. Elaine Williams, Cranford, N.J.

[73] Assignee: The Raymond Lee Organization, Inc., New York, N.Y.

[21] Appl. No.: 729,333

[22] Filed: Oct. 4, 1976

[51] Int. Cl.[2] ..... H05B 1/00

[52] U.S. Cl. ..... 219/218; 4/179; 4/182; 128/370

[58] Field of Search ..... 219/201, 217, 218, 533, 219/380; 128/365, 369, 370, 403, 254; 4/159, 172, 182, 179

[56] References Cited

U.S. PATENT DOCUMENTS

| | | | |
|---|---|---|---|
| 2,904,037 | 9/1959 | Cassidy | 128/370 X |
| 3,380,080 | 4/1968 | Farrell | 128/370 X |

FOREIGN PATENT DOCUMENTS

| | | | |
|---|---|---|---|
| 183,797 | 7/1936 | Switzerland | 128/365 |

*Primary Examiner*—C. L. Albritton
*Attorney, Agent, or Firm*—Howard I. Podell

[57] ABSTRACT

A bench unit, fitted with compartments open to the top and with covered side compartments for use in rendering a pedicure treatment. The bench is of a height to enable a seated patient to rest one or both feet in individual open compartments with a first central flat tray section serving as a rest for a foot being treated or as a storage space for treating implements or towels. Two of the open compartments are fitted with removable foot bath pans with the walls of these bathing compartments fitted with electrical heating elements.

1 Claim, 2 Drawing Figures

PEDICURE TREATMENT UNIT

SUMMARY OF THE INVENTION

My invention is a bench unit, fitted with compartments open to the top and with covered side compartments for use in rendering a pedicure treatment. The bench is of a height to enable a seated patient to rest one or both feet in individual open compartments with a first central flat tray section serving as a rest for a foot being treated or as a storage space for treating implements or towels. Two of the open compartments are fitted with removable foot bath pans with the walls of these bathing compartments fitted with electrical heating elements.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
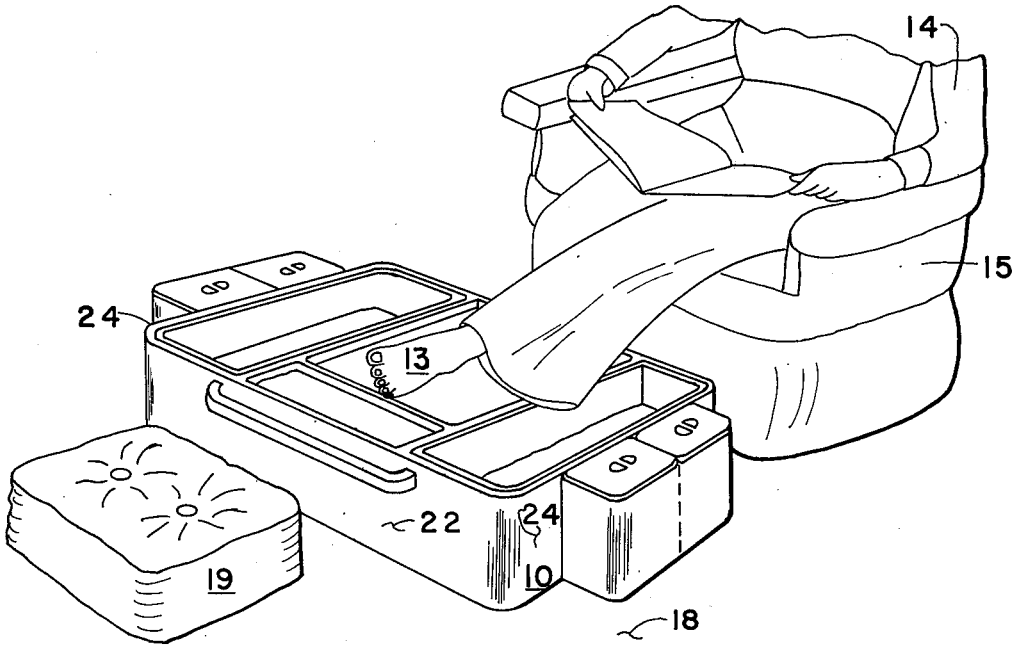
FIG. 1 is a perspective view of the invention in use.
Figure 2:
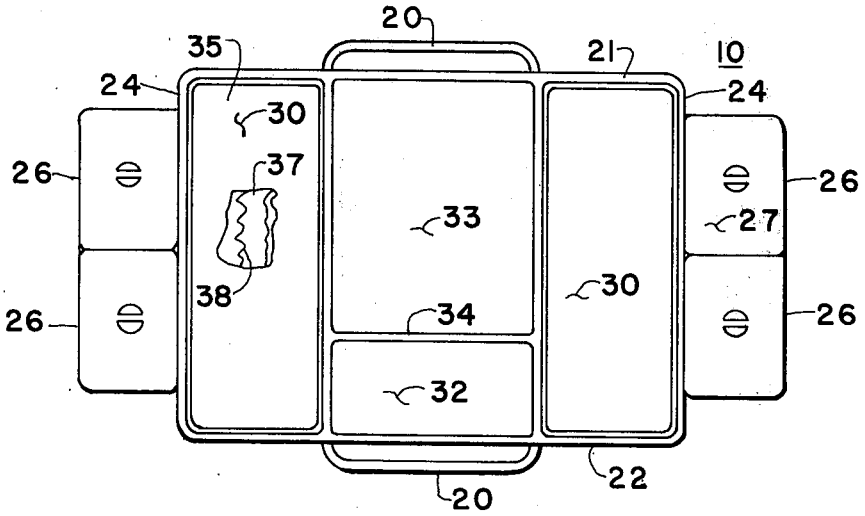
FIG. 2 is a plan view of the invention.

Turning now descriptively to the drawings, in which similar reference characters denote similar elements throughout the several views, FIGS. 1–2 illustrate the bench unit 10 which is employed in the rendering of pedicure treatment to the feet 13 of a patient 14 seated on an adjacent chair 15.

The bench unit rests directly on the floor 18 adjacent chair 15 and is of a height to be convenient both to the seated patient 14 and to the operator who seats himself on an adjacent stool 19.

Bench unit is fitted on each of a pair of opposed sides 21 and 22 with a projecting handle grip 20 that extends laterally from the respective side 21 or 22. A pair of containers 26 are externally fixed to each end side 24 with containers 26 each fitted with a removable cover 27.

A pair of spaced open compartments 30 are recessed from the top of the unit, with compartments 30 laterally spaced apart by recessed central flat tray sections 32 and 33, and with tray sections 32 and 33 separated by an upraised lateral ridge 34.

Each compartment 30 is fitted with a removable bath pan 35 and the walls and bottom 37 of each compartment 30 are fitted with electrical heating elements 38.

In use, each foot of a patient may be individually bathed in a pan 35 located in a lateral compartment 30, with tray section 32 and 33 employed for retention of fresh or soiled implements or towels and with compartments 26 employed for storage of implements, towels and treatment material. Alternately, as shown in FIG. 1, a foot 13 may be rested on central tray 33 during treatment.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A portable unit for use in rendering of a pedicure treatment in the form of a bench, said bench fitted on each side with at least one storage compartment, each fitted with a cover resting on the top of each storage compartment, with a pair of recessed first chambers, each open to the top of said unit and spaced apart from each other by a central recessed second chamber open to the top of said unit, said first chambers each fitted with a removable bath pan and with walls of said first chambers each fitted with heating means, such that a patient may bathe each foot in an individual first chamber, with the bottom of the central compartment serving as a rest upon which the patient may place either foot for treatment by an operator in front of the unit, with said storage compartments serving as containers for treatment implements and towels.

* * * * *